US012709358B2

(12) United States Patent
Riem et al.

(10) Patent No.: US 12,709,358 B2
(45) Date of Patent: Aug. 18, 2026

(54) BOARDING PLATFORM

(71) Applicant: Leisure Properties LLC, West Frankfort, IL (US)

(72) Inventors: Kevin Riem, West Frankfort, IL (US); Evan Forbes, West Frankfort, IL (US)

(73) Assignee: Leisure Properties LLC, West Frankfort, IL (US)

( * ) Notice: Subject to any disclaimer, the term of this patent is extended or adjusted under 35 U.S.C. 154(b) by 363 days.

(21) Appl. No.: 18/521,280

(22) Filed: Nov. 28, 2023

(65) Prior Publication Data

US 2024/0227986 A1 Jul. 11, 2024

Related U.S. Application Data

(60) Provisional application No. 63/478,614, filed on Jan. 5, 2023.

(51) Int. Cl.
*B63B 27/14* (2006.01)
*B63B 29/02* (2006.01)

(52) U.S. Cl.
CPC ..... *B63B 27/146* (2013.01); *B63B 2029/022* (2013.01)

(58) Field of Classification Search
CPC ..... B63B 27/146; B63B 2029/022
See application file for complete search history.

(56) References Cited

U.S. PATENT DOCUMENTS 369,129 A * 8/1887 Sheldon ..... B61D 23/02 105/447
3,716,254 A * 2/1973 Tarvin ..... B60R 3/02 280/166
3,756,622 A * 9/1973 Pyle ..... B60R 3/02 280/166
3,892,290 A * 7/1975 Lang ..... E06C 1/52 182/163
4,191,388 A * 3/1980 Barksdale ..... B60R 3/02 280/166
4,293,967 A * 10/1981 Ord ..... B63B 27/14 14/71.1
4,462,485 A * 7/1984 Terry ..... B63B 27/14 280/166
4,495,883 A * 1/1985 Hoy ..... B63B 27/14 114/364
4,726,317 A * 2/1988 Ritten ..... B63B 27/14 182/91
4,765,438 A * 8/1988 Ritten ..... B63B 27/14 441/39

(Continued)

FOREIGN PATENT DOCUMENTS

EP 1854715 A1 * 11/2007 ..... B63B 27/143
EP 3771631 A1 * 2/2021 ..... B63B 27/14

(Continued)

*Primary Examiner* — Brian Christopher Delrue
(74) *Attorney, Agent, or Firm* — Stinson LLP

(57) ABSTRACT

A platform assembly for a boat has a box assembly that can be mounted in a hull of a boat. A platform assembly is received in the box assembly in a stowed position, but can be actuated to extend to a deployed position projecting from the hull. The platform may include ladder and/or stairs to facilitate entry into the boat, particularly from the water. In some versions, a fold-down railing can be used together with the platform.

17 Claims, 9 Drawing Sheets

(56) References Cited

U.S. PATENT DOCUMENTS

| | | | | | |
|---|---|---|---|---|---|
| 4,799,447 | A * | 1/1989 | Hebert | B63B 27/14 | 144/362 |
| 4,823,910 | A * | 4/1989 | Day | E06C 5/02 | 182/84 |
| 4,930,797 | A * | 6/1990 | Parrill | B60R 3/02 | 280/166 |
| 5,028,063 | A * | 7/1991 | Andrews | B60R 3/02 | 280/166 |
| 5,039,119 | A * | 8/1991 | Baughman | B60R 3/005 | 182/127 |
| 5,123,372 | A * | 6/1992 | Kobayashi | B63B 27/14 | 114/362 |
| 5,458,080 | A * | 10/1995 | Jaramillo, Sr. | B63B 27/14 | 114/362 |
| 7,182,175 | B1 * | 2/2007 | Schmitt | B63B 27/143 | 182/88 |
| 7,237,503 | B2 * | 7/2007 | Stepp | B63B 29/20 | 114/361 |
| 9,334,023 | B2 * | 5/2016 | Admire | B63B 29/00 | |
| 9,708,039 | B2 * | 7/2017 | Neese | B63B 27/14 | |
| 10,011,328 | B2 * | 7/2018 | Dick | B63B 25/28 | |
| 10,086,913 | B2 * | 10/2018 | Fafard | B63B 27/14 | |
| 10,106,227 | B2 * | 10/2018 | Allender | B63B 17/04 | |
| 10,220,920 | B1 * | 3/2019 | Holseberg | B63B 19/08 | |
| 10,351,215 | B2 * | 7/2019 | Scozzoli | B63B 27/30 | |
| 10,399,645 | B1 * | 9/2019 | Holmes | B63B 27/146 | |
| 10,407,131 | B1 * | 9/2019 | Ward | B63B 17/00 | |
| 11,401,012 | B2 * | 8/2022 | Fafard | B63B 29/02 | |
| 11,554,836 | B2 | 1/2023 | Riem et al. | | |
| 11,780,537 | B2 * | 10/2023 | Fafard | B63B 27/146 | 114/362 |
| 11,932,356 | B1 * | 3/2024 | Ramsdell | B63B 27/146 | |
| 2002/0003340 | A1 * | 1/2002 | Hallquist | B60R 3/02 | 280/163 |
| 2002/0070577 | A1 * | 6/2002 | Pool, III | B60R 3/02 | 296/62 |
| 2003/0070875 | A1 * | 4/2003 | Medsker | B60R 3/02 | 182/127 |
| 2004/0160079 | A1 * | 8/2004 | Harper | B62D 33/03 | 296/61 |
| 2005/0016439 | A1 * | 1/2005 | Mardikian | E06C 5/04 | 114/362 |
| 2009/0199758 | A1 * | 8/2009 | Garelick | B63B 27/146 | 114/362 |
| 2014/0338480 | A1 * | 11/2014 | Wu | F16H 25/20 | 74/89.23 |
| 2015/0377329 | A1 * | 12/2015 | Wu | F16H 25/20 | 74/89.23 |
| 2021/0245838 | A1 * | 8/2021 | Waters | B63B 29/04 | |
| 2024/0190536 | A1 * | 6/2024 | Rogers | B63B 27/146 | |
| 2025/0065808 | A1 * | 2/2025 | Ebbenga | B60R 3/02 | |

FOREIGN PATENT DOCUMENTS

| | | | | |
|---|---|---|---|---|
| EP | 3771631 | B1 * | 1/2022 | B63B 27/14 |
| WO | WO-2012011137 | A1 * | 1/2012 | B63B 27/146 |
| WO | WO-2016116771 | A1 * | 7/2016 | B63B 27/16 |

* cited by examiner

BOARDING PLATFORM

FIELD

The present disclosure generally relates to boarding platforms for boats, and more particularly to a retractable boarding platform assembly.

BACKGROUND

Boats are common and popular recreational vehicles, allowing users to navigate waterways and engage in watersports. Entering the boat from the water can often be difficult. In the water, the person wanting to board is well below the passenger compartment of the boat and must climb up into the boat. Some boats have swim platforms. However, these platforms are typically above the waterline so that climbing from the water back onto the platform can require substantial effort. Often the platforms are oddly shaped and have no surfaces which can be easily grasped to pull oneself out of the water. The swim platforms open to the rear of the boat, reducing the available space to access the platform from the water because of the location of the engine(s).

SUMMARY

In one aspect, a platform assembly for a boat generally comprises a box assembly configured to be mounted generally within the boat. The box assembly has an opening. A platform is configured to travel between a stowed position and a deployed position, the stowed position being substantially inside the box assembly and the deployed position protruding outward through the opening in the box assembly. A step assembly operatively connected to the platform has a plurality of collapsible steps.

In another aspect, a platform assembly for a boat generally comprises a box assembly adapted for mounting generally within the boat. The box assembly has a distal opening. A platform is configured to travel between a stowed position and a deployed position. The stowed position is substantially inside the box assembly and the deployed position protruding outward from the box assembly through the distal opening. One or more switches are configured to automatically control the travel of the platform.

In a further aspect, a boat generally comprises a hull, and a deck supported by the hull on which one or more passengers of the boat are supported for movement with the boat. A platform assembly mounted on the boat, includes a platform movable linearly with respect to the hull between a deployed position in which the platform projects laterally from the hull, and a retracted position.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
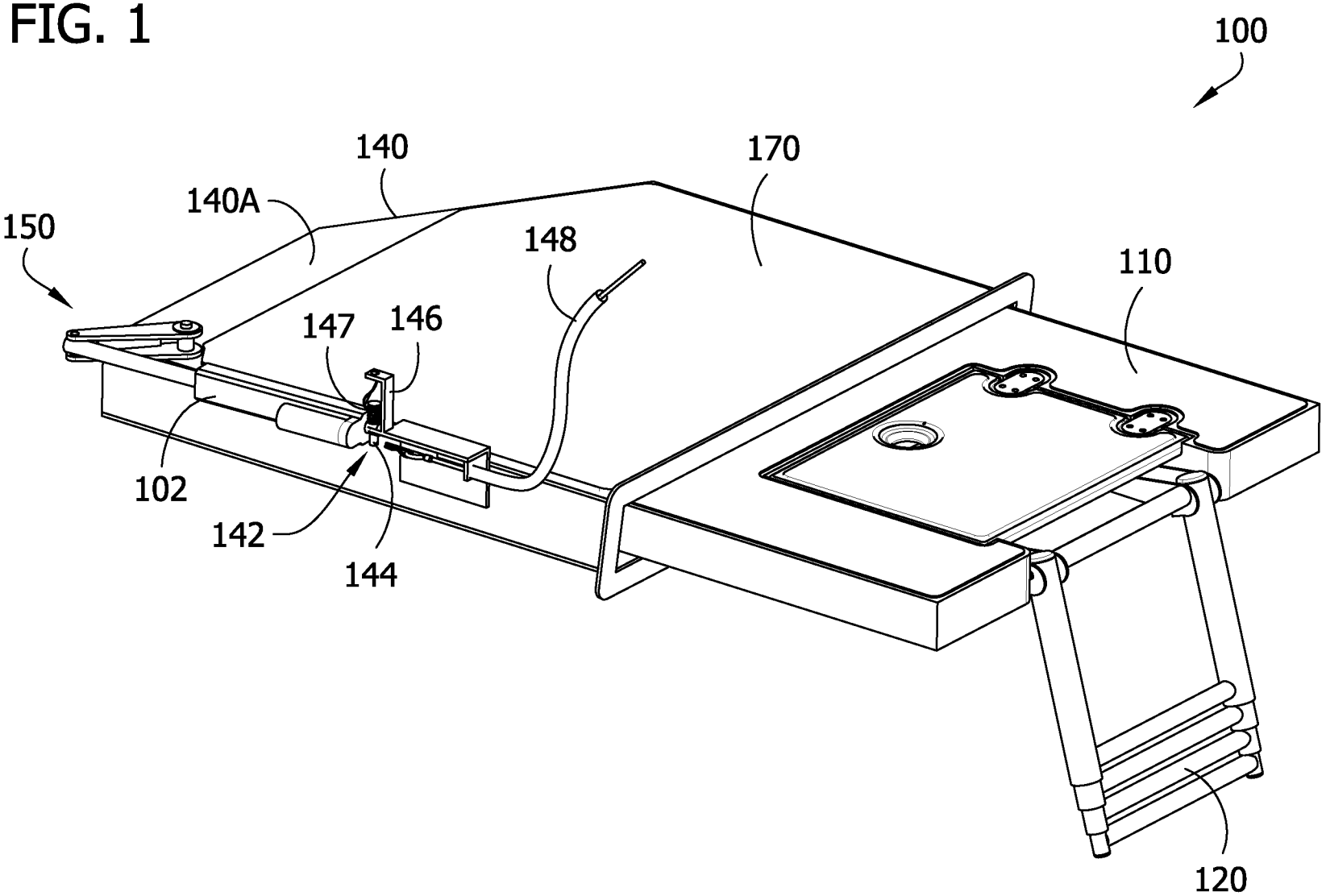
FIG. 1 is a perspective of a platform assembly showing a platform in a deployed position.
Figure 2:
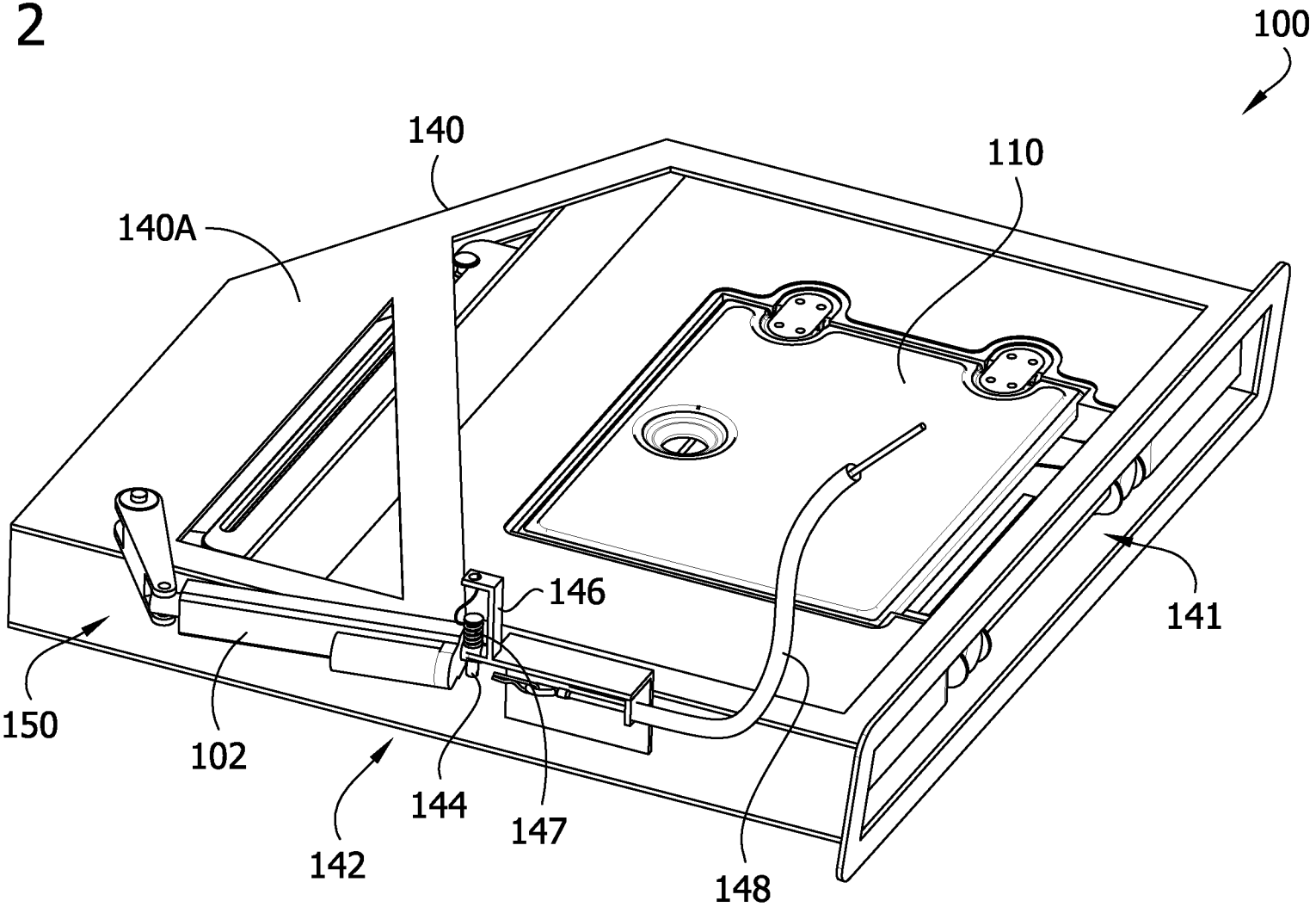
FIG. 2 is the perspective of FIG. 1 showing the platform in a stowed position and with a cover plate of a box assembly removed to show the platform in the box assembly.

FIG. 1 below is a perspective view of a platform assembly 100 for the boat (not shown) that includes a platform 110 in an extended or deployed configuration. FIG. 2 is a perspective view of the assembly 100 where the platform 110 is in a retracted or stowed configuration, and with top plates of a box assembly removed to show internal construction. In general, the platform assembly 100 is installed in a portion of the hull of the boat, and the platform 110 is configured to be extended outward from a stowed position substantially inside the hull, to a deployed position protruding from the hull for use, and then back to the stowed position after use. The extension of the platform 110 allows a passenger (generally, a user) to climb upward or downward using a collapsible ladder assembly 120 that can be stowed substantially inside the platform when not in use. The platform assembly 100 also includes the box assembly 140 that has a distal opening 141 that is configured to be substantially flush with the hull of the boat when the box assembly 140 is installed on the boat. The box assembly 140, when installed on the boat, is substantially entirely within the hull. The distal opening 141 allows the platform 110 to travel in a linear path between the deployed configuration in which the platform 110 protrudes from the hull of boat and the stowed configuration in which the platform 110 fits closely inside the box assembly 140 without protruding from the hull. It is contemplated that, except for the distal opening 141, the box assembly 140 is welded or otherwise sealed to prevent water from leaking into the boat interior.

Figure 3:
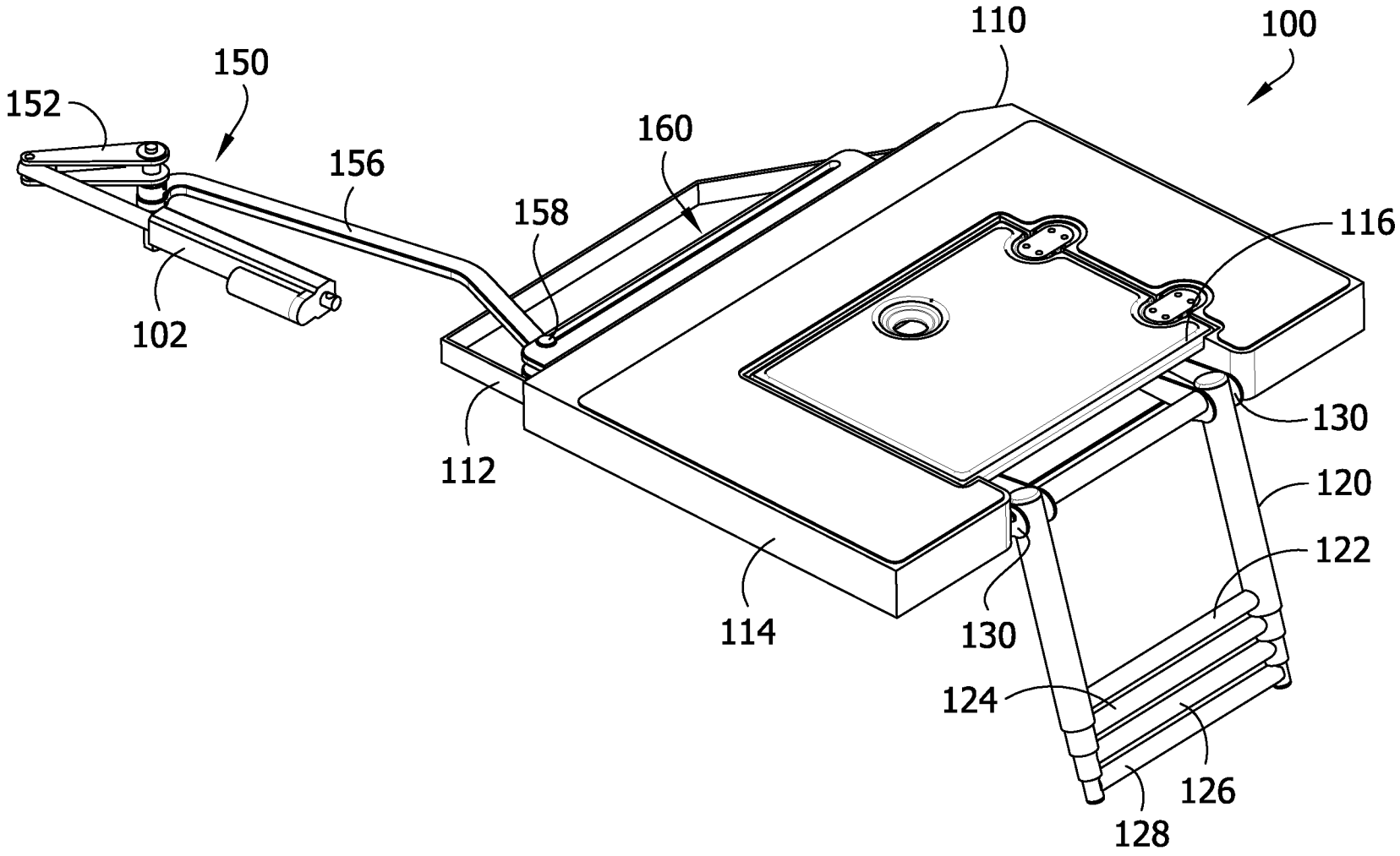
FIG. 3 is a perspective of the platform and an actuator assembly of the platform assembly.
Figure 4:
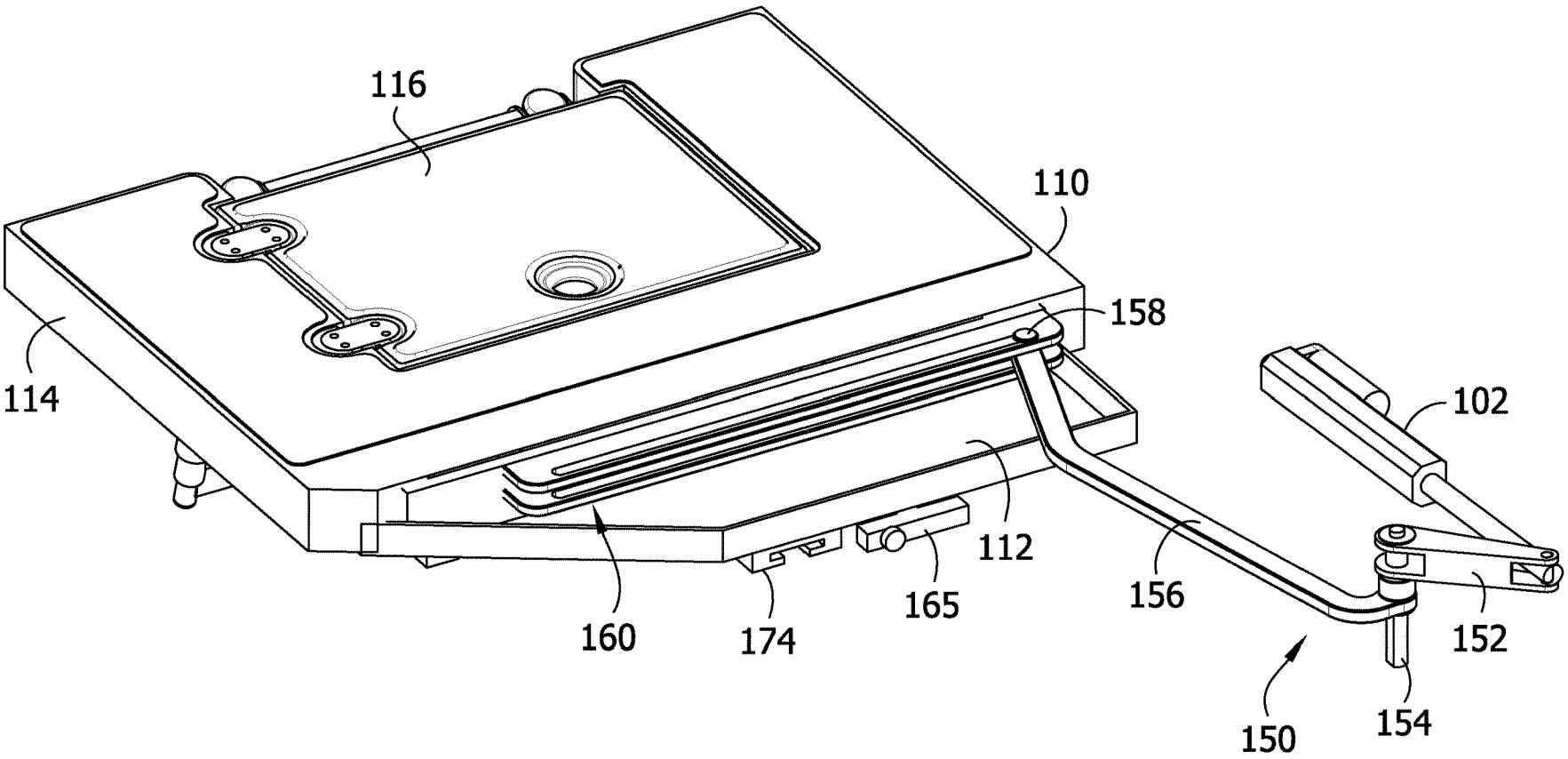
FIG. 4 is a perspective similar to FIG. 3, but from a rear vantage.
Figure 5:
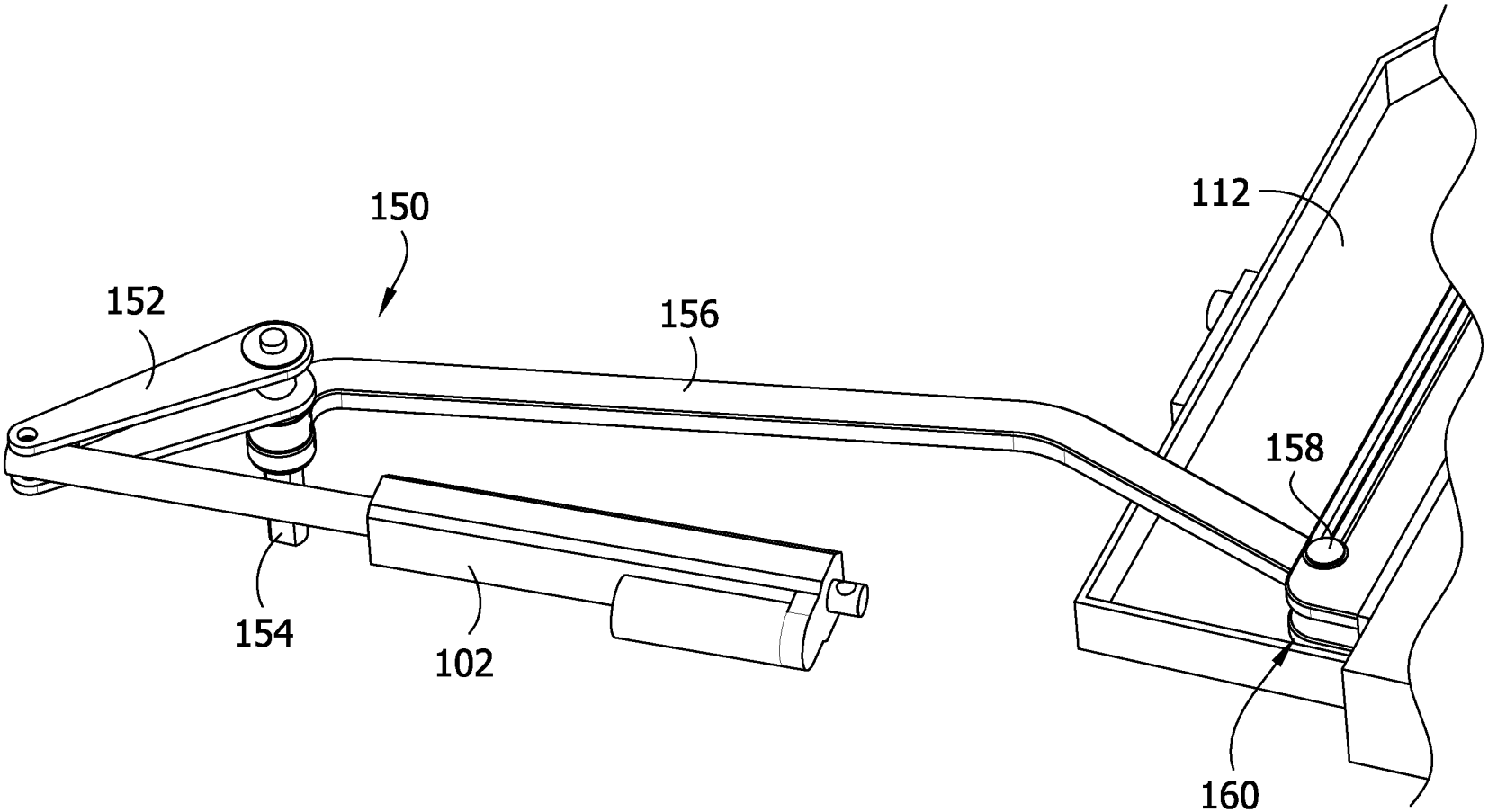
FIG. 5 is an enlarged, fragmentary perspective of the platform and actuator assembly of FIG. 3.

As best seen in FIGS. 3-5 below, which show perspectives of the assembly 100 from various angles with the box assembly 140 removed, the platform assembly 100 also includes an electric actuator 102 (generally, an actuator) and a sliding pivot mechanism 150 (collectively, an "actuator mechanism") that connects the platform 110 to the box assembly 140 and the electric actuator 102. The electric actuator 102 provides powered actuation for the platform 110, though in some embodiments it is contemplated that the assembly 100 may be driven manually in addition to or instead of by using the electric actuator 102 or other powered actuator.

An end of the electric actuator 102 is releasably connected to the box assembly 140 by a spring-loaded connector 142. The spring-loaded connection includes a pin 144 connected by a bracket 146 to the box assembly 140. The pin 144 is received through a hole in a connector in the electric actuator 102 to pivotably attach the cylinder to the box assembly 140. A spring 147 biases the pin 144 upwardly to release the connection of the electric actuator 102 to the box assembly 140. An actuator cable 148 is operatively connected to the pin 144 so that actuation of the actuator cable releases the pin, allowing it to be moved up by the spring 147 to disconnect the electric actuator 102 from the box assembly 140. The actuator cable 148 is shown broken away in FIG. 1. The spring-loaded connector 142 and actuator cable 148 form part of a quick release of the electric actuator 102 from the box assembly 140. In the released condition, the platform 110 can be pulled out or pushed in manually. Thus, the platform 110 could be moved even if there was a power failure on the boat. Referring to FIGS. 1-3 and 6, the box assembly 140 further includes a cover plate 170.

As is shown in FIGS. 3-5 below, the pivot mechanism 150 includes a proximal pivot arm 152, a proximal pivot pin 154, an actuator arm 156, and a slide pivot pin 158. The proximal pivot arm 152 is pivotally connected to the electric actuator at a first end and fastens to the proximal pivot pin 154 at a second end that is opposite the first end. The proximal pivot arm 152 is configured to rotate with the proximal pivot pin 154 without contacting the box assembly 140 when the assembly 100 is actuated. The proximal pivot pin 154 is configured to be received by a pivot sheath 143 that is welded to the box assembly 140 (see, FIG. 6) such that the pivot pin can rotate as the assembly 100 is actuated but is restricted from moving translationally relative to the box assembly and the boat. The actuator arm 156 has a proximal end that connects to the proximal pivot pin 154 such that the actuator arm 156 pivots with the proximal pivot pin 154, defining a linkage that extends between the cylinder 102 and the slide pivot pin 158. The actuator arm 156 has a distal end that is pivotably connected to the slide pivot pin 158. In particular, the distal end of the actuator arm 156 may travel with slide pivot pin 158 through grooves in a push/pull member 160 that is attached to the movable platform 110, allowing the platform to be pushed outward and pulled inward relative to the distal opening 141 as the pivot linkage is driven by the electric actuator 102. In the illustrated embodiment, the actuator arm 156 is located inside the box assembly 140 (i.e., beneath an open, top wall member 140A of the box assembly shown in FIG. 6), while the proximal pivot arm 152 is located outside the box assembly.

In alternative embodiments, different systems can be used to actuate the platform 110 instead of the pivot mechanism 150 and/or electric actuator 102. For example, an alternative assembly may use an electrical motor and gears or other similar components known in the art that can actuate the platform 110 as is generally described herein.

Referring now to FIGS. 3-6, the platform 110 will be described. The platform 110 includes a base plate 112, and an integrally formed fiberglass body 114 attached to the upper surface of the base plate 112. A hatch 116 is fastened to the body 114 so that the hatch can be opened and closed. Textured upper pads 118 provide improved traction when walking or standing on the platform. The push/pull member 160 is secured to the base plate 112 and connected to the pivot mechanism 150. Slide blocks 174 attached to the bottom of the base plate 112 slidably engage three slide rails 176 installed on a bottom wall member 140B the box assembly 140. The box assembly further includes a side wall member 140C extending between the top wall member 140A and the bottom wall member 140B. It is contemplated that one or both of the slide blocks 174 and the slide rails 176 are made of marine grade, corrosion-resistant, and low-friction materials such as a Delrin® material, aluminum or stainless steel to facilitate movement of the platform 110 with respect to the box assembly 140.

The base plate 112, the body 114, and the hatch 116 are cooperatively dimensioned to provide a space for the ladder assembly 120 to be installed and stowed so that the platform 110 can fit fully inside the box assembly 140 when the ladder assembly is in its stowed configuration. When the platform 110 is in its deployed position, the hatch 116 can be opened and the ladder assembly 120 can be pivoted out to the side of the platform. The ladder assembly 120 can also be expanded. After the ladder assembly 120 has been unfolded and expanded, the hatch 116 can be closed to provide a substantially level walking surface for the user.

Figure 6:
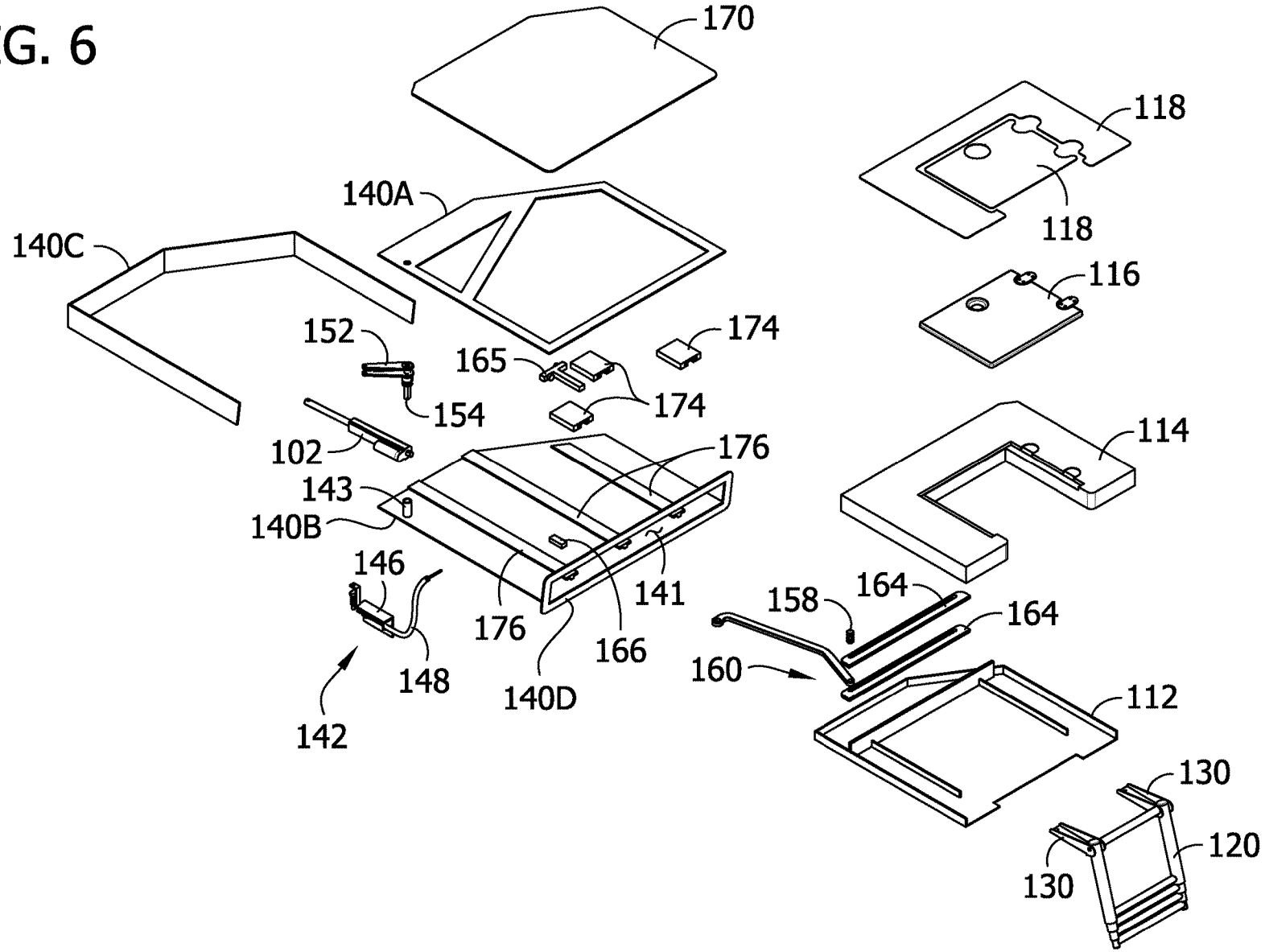
FIG. 6 is an exploded perspective of the platform assembly.

As can further be seen in FIG. 6, the push/pull member 160 includes upper and lower slotted guides 164. It will be appreciated that the slotted guides 164 are aligned to receive the slide pin 158 to allow for the actuation of the pivot mechanism 150. A bumper set 165 is mounted on the base plate 112 of the platform 110. The bumper set 165 operates to prevent the platform 110 from being pulled out of the box assembly 140, also to dampen the impact of the platform as it is pulled back into the box assembly by the electric actuator 102. A stop 166 welded to the bottom wall member 140B of the box assembly 140 is positioned to engage the bumper set 165 as the platform 110 is being moved out of the box assembly. This prevents the platform 110 from being pulled out of the box assembly 140. The bumper set 165 is also positioned to engage the side wall member 140C of the box assembly 140 as the platform slides into the box assembly. The bumper set 165 absorbs the impact of the retracting platform 110 and protects the box assembly 140 and platform from damage.

The box assembly 140 further includes a face plate 140D that generally defines the distal opening 141 of the box assembly. The box assembly 140 is configured to conform closely to the platform 110 to limit the amount of water that enters into the interior region of the box assembly. It is contemplated that the bottom wall member 140B of the box assembly is angled slightly downward relative to the distal opening 141 to urge water to flow out of the box assembly 140 for reducing corrosion and other water-related damage. In the present embodiment, the pivot sheath 143 is welded to the bottom wall member 140B in an inner corner of the box assembly 140 to hold the proximal pivot pin 154 in place. It is contemplated that one or more seals (not shown) can be used with the pivot pin 154 and/or pivot mechanism 150 to prevent water leaving the interior of the box assembly 140. Further, the bracket 146 is welded to the side wall member 140C for supporting and releasably retaining the electric actuator 102 in rotational engagement. The side wall member 140C is welded to the base plate 144 below and the top wall member 140A above, and the distal plate 146 is welded to the distal edges of the base plate 142, the side wall 144, and the top wall member 140A. The cover plates 170 are configured to seal an upper portion of the box assembly 140 when installed above the top wall member 140A.

Referring to FIG. 3, the collapsible ladder assembly 120 (generally, a step assembly) includes four telescoping sections 122, 124, 126, 128 and two support brackets 130 that are attached to the base plate 112 of the platform 110. In the present embodiment, the ladder section 122 is fastened to the brackets 130 such that the ladder assembly 120 may pivot between a stowed configuration (generally inside the space defined by the base plate 112, the body 114, and the hatch 116) and a deployed configuration where the ladder assembly 120 is suspended from the side of the platform 110 either vertically or at a predetermined angle suitable for users to climb upward toward and/or downward from the platform 110. Each subsequent ladder section (e.g., 124, 126, 128) has side supports that are narrower than the respective side supports of the previous ladder section to establish the telescoping configuration, and each successive ladder section is restricted from traveling more than a maximum distance from the previous ladder section (e.g., by means of collars or pins, not shown). Each ladder section includes a generally tubular step member that is attached to the section's respective side supports near the bottom. In this manner, the ladder assembly 120 can be stowed in a collapsed position in which the respective step members of the ladder sections 122, 124, 126, 128 remain in close proximity for improved compactness, and the ladder assembly 120 can be converted to an expanded position in which the step members are at their maximum distance of separation. It will be appreciated that the ladder assembly 120 is generally configured to safely support loads according to the ABYC (American Boat and Yacht Council) Standards, section H-41 effective as of the filing date of this patent application.

During use of the platform assembly 100, the user may move the platform 110 from the stowed configuration to the deployed configuration by activating the electric actuator 102 and driving the platform 110 outward via the pivot mechanism 150. The user may then open the hatch 116, unfold the ladder assembly 120, and restore the hatch 116 to its closed position. While the platform 110 is in the deployed configuration, the user may climb up or down the ladder assembly 120 and/or stand on the platform 110. When the user is ready to return the platform to the stowed position, the user may open the hatch 116, collapse and flip the ladder assembly 120 into the platform, and subsequently close the hatch. Then, the user may activate the electric actuator 102 to drive the platform 110 inward via the pivot mechanism 150 into the box assembly 140.

Figure 7:
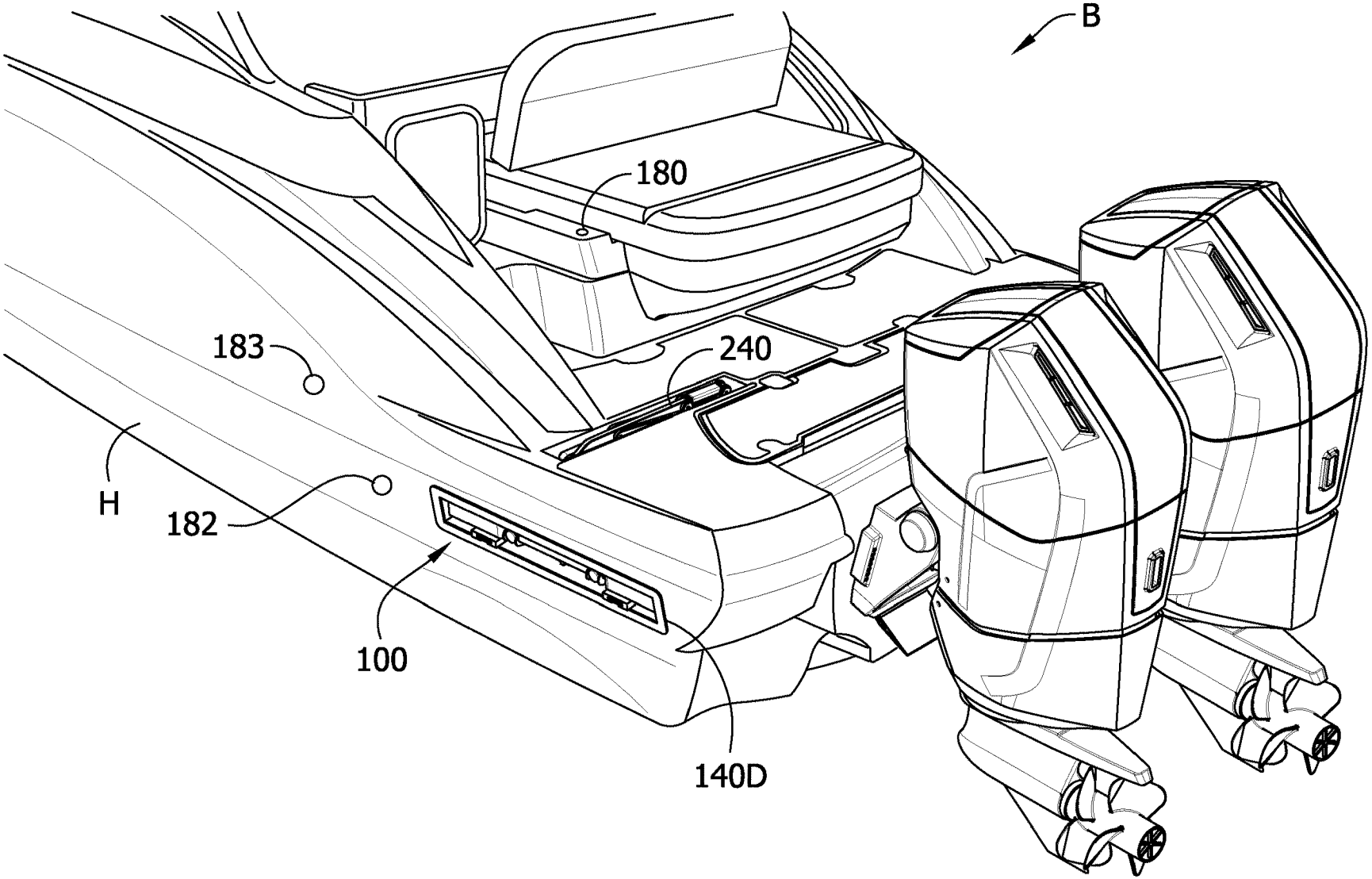
FIG. 7 is a fragmentary perspective of a boat including the platform assembly in the stowed position.
Figure 8:
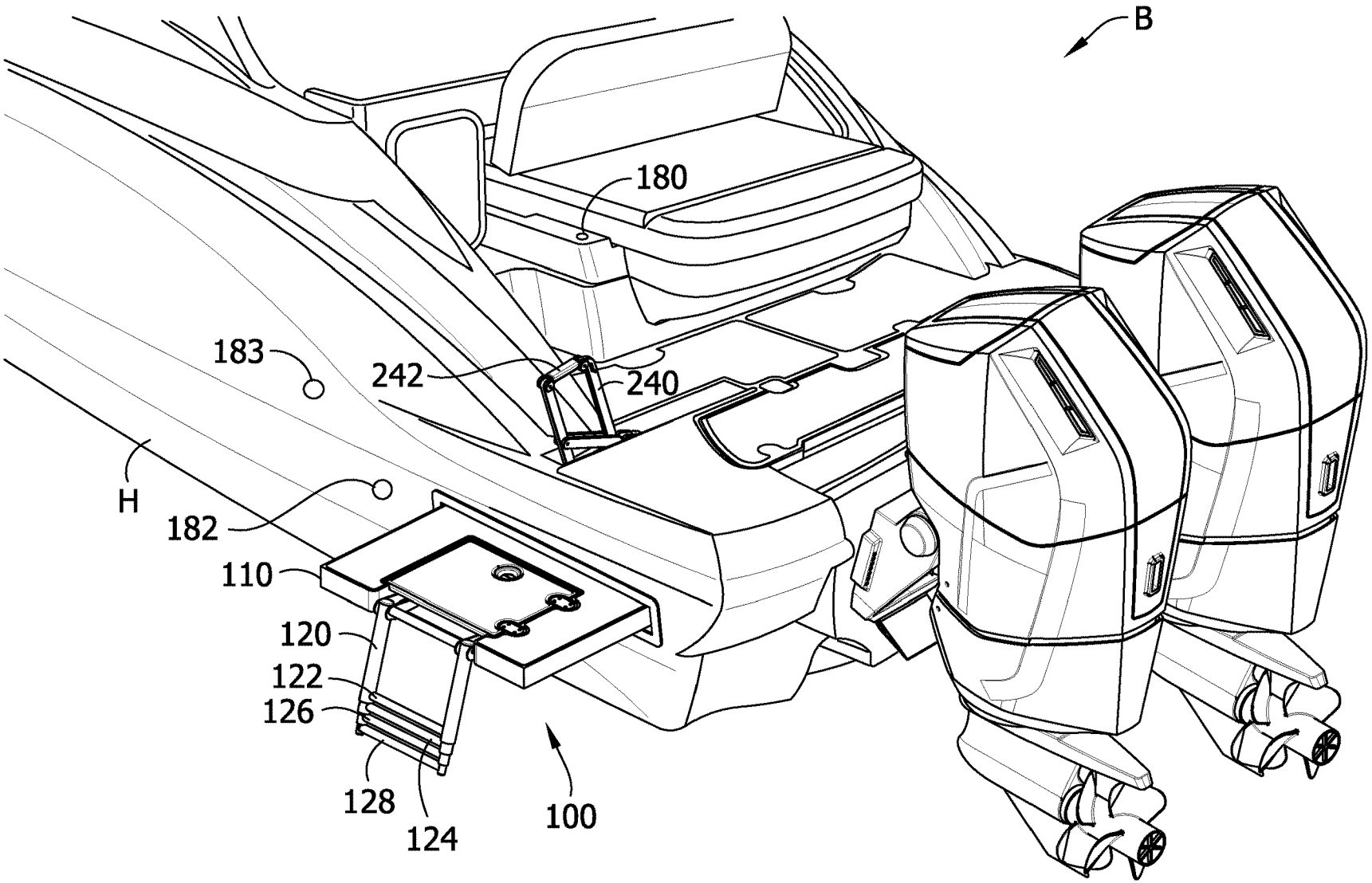
FIG. 8 is the perspective of FIG. 7 with the platform assembly in the deployed position.

Referring now to FIGS. 7 and 8, a boat B includes the platform assembly 100. As may be seen in FIG. 7, the platform assembly in the stowed position is substantially entirely within a hull H of the boat B. Only the face plate 140D of the box assembly 140 is on the exterior of the hull H. The platform assembly 100 is shown in the deployed position in FIG. 8. The platform 110 is extended from the hull H and the ladder 120 is disposed outside the platform, but with the telescoping sections 122, 124, 126, 128 still in their collapsed configuration. It will be appreciated that the sections 124, 126, 128 can be extended downward from the position shown in FIG. 8.

In addition, the platform assembly 100 is shown with a fold-down railing 240 (described below). The railing 240 can be used to assist a passenger on the platform 110 in entering the boat B. The boat B has a first switch 180 that is located within the boat B so that it is easily accessible from a position of a passenger in the boat to interface with the actuator (e.g., the electric actuator 102) to move the platform 110 between the stowed and deployed positions. In the illustrated embodiment, the switch 180 can be a rocker switch. Pressing an upper part of the switch 180 causes the platform 110 to be deployed. The electric actuator 102 extends an arm, causing the pivot pin 154 and actuator arm 156 to rotate about the axis of the pivot pin 154. The actuator arm 156 moves the guide pivot pin 158 to move in the slots of the guides 164. This movement of the guide pivot pin 158 pushes the platform 110 outward from the box assembly 140. Pressing a lower part of the switch 180 causes the platform to be stowed. In that event, the electric actuator 102 retracts its arm, causing the pivot pin 154 and actuator arm 156 to rotate in an opposite direction. The guide pivot pin 158 slides in the guides 164, causing the platform 110 to be pulled into the box assembly 140.

As shown, the railing 240 is lifted up manually from he collapsed position shown in FIG. 7 to the upright position shown in FIG. 8. The railing 240 is also collapsed manually. However, in some embodiments, the button 180 may also cause the railing 240 to automatically move. It will be understood that the railing 240 could be separately controlled. A second switch 182 is located on the hull H in a position making it readily accessible to a person who wishes to deploy or retract the platform 110 from outside the boat. In some embodiments, the second switch 182 can also cause the railing 240 to move to the upright (or collapsed) position. Other control arrangements are possible. Moreover, manual deployment of either or both of the platform assembly 100 and the railing 240 could be used.

An actuator 183 is mounted on the exterior of the boat for manual release of the platform 110 (see, FIGS. 7 and 8). A person in the water can push a cover of the actuator 183 to open the cover and expose a pull (not shown) attached to the cable actuator 148. The person may grasp the pull and move it outwardly to cause the connection of the electric actuator 102 to the platform 110 to be released, as described above. The platform 110 can be pulled out manually for entering the boat from the water. This is useful in the event there is a power failure on the boat, for example.

Figure 9:
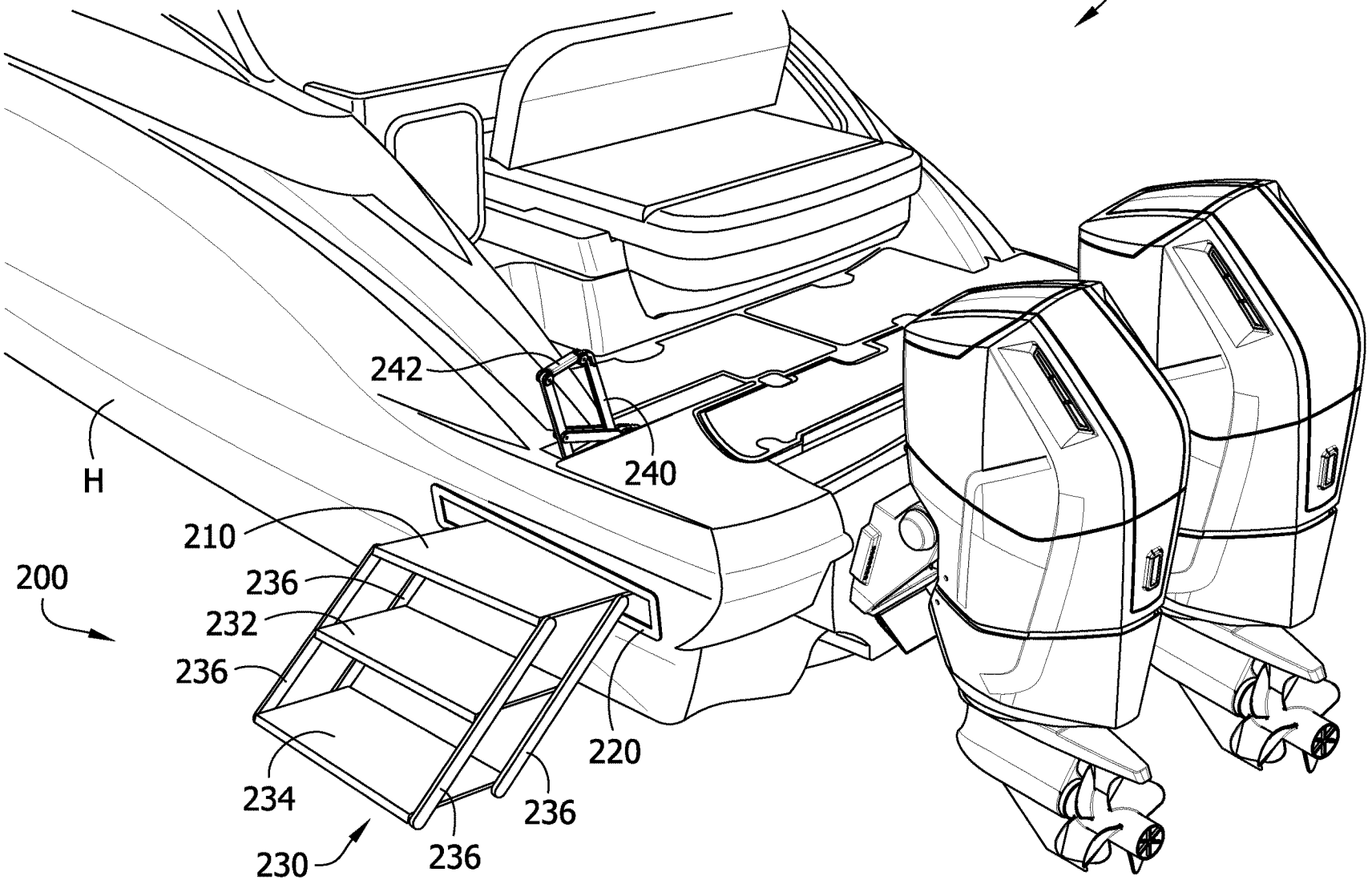
FIG. 9 is a fragmentary perspective of a boat including a platform assembly of another version in which the platform comprises stairs.

Now referring to FIG. 9, a second embodiment of the platform assembly generally designated by the reference number 200 will be described. The platform assembly 200 includes a platform 210 that can be moved between a stowed position and a deployed position through an opening in the box assembly 220 using generally the same actuating mechanisms as previously described in connection with the assembly 100. Additionally, the assembly 200 includes a railing 240 positioned near the platform 210 that can provide a temporary support for the user while climbing up or down using the assembly 200. The platform assembly 200 and railing 240 can be used by a person boarding the boat B either from the water or from anywhere outboard of the boat (e.g., a dock or other boat). A handle 242 of the railing 240 can be grasped by the person to assist moving into the boat B.

The platform 210 has a flat upper surface that generally defines an upper step. A folding stair mechanism 230 (broadly, "a step assembly") is attached to the bottom of the platform 210. The stair mechanism 230 is generally a parallel motion linkage with a central tread 232 and a lower tread 234 that are attached to support members 236. The central tread 232 and the lower tread 234 are spaced apart relative to the linkage members 236 such that the platform 210, the central tread 232, and the lower tread 234 remain substantially parallel as the stair mechanism 230 swings downward, thus defining three steps for the user to climb on when using the assembly 200. In the present embodiment, it is contemplated that the stair mechanism 230 automatically expands as the platform 210 deploys and automatically collapses as the platform 210 is stowed. In one embodiment, the linkage members 236 are constructed so that the weight of the stair treads 232, 234 causes the stair mechanism 230 to unfold as it emerges from the hull. When the stair mechanism 230 is retracted, engagement of the lower support members 236 with an edge of the box assembly (not shown in FIG. 9), pivots the lower support members upward and causes the stair treads 232, 234 to move upward, while pivoting with respect to the support members, into alignment with the flat upper surface so that the entire unit can pass into the box assembly in the boat hull. Thus, the folding and unfolding of the stair mechanism 230 is accomplished automatically. The mechanism for actuating the extension and retraction of the platform 210 can be essentially identical to that shown for the embodiment of FIGS. 1-6. In other embodiments, other suitable stair mechanisms may be configured.

The railing 240 is collapsible, allowing the user to fold the railing 240 into a stowed position that generally fits in a recess in the boat (e.g., when the platform 210 is also in the stowed position) and a deployed position in which a handle 242 of the railing 240 is located in a position relative to the platform 210 to provide a place for the user to grip the railing 240, for instance when the user is climbing up or down when the platform 210 is in the deployed position. Construction and operation of the railing 240 can be the same as described in co-assigned, U.S. Pat. No. 11,554,836, the disclose of which is incorporated herein in its entirety.

It will be apparent that modifications and variations are possible without departing from the scope of the invention defined in the appended claims. As various changes could be made in the above constructions and methods without departing from the scope of the invention, it is intended that all matter contained in the above description and shown in the accompanying drawings shall be interpreted as illustrative and not in a limiting sense.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A platform assembly for a boat comprising:

a box assembly configured to be mounted generally within the boat, the box assembly having an opening, and a platform configured to travel between a stowed position and a deployed position, the stowed position being substantially inside the box assembly and the deployed position protruding outward through the opening in the box assembly; and an actuator arm pivotally mounted on the box assembly and connected to the platform for moving the platform between the stowed position and the deployed position by pivoting of the actuator arm.

2. The platform assembly as claimed in claim 1, the platform being configured to travel automatically between the stowed position and the deployed position.

3. The platform assembly as claimed in claim 1, further comprising a step assembly operatively connected to the platform, the step assembly including a plurality of steps having a collapsed position in which the steps are collapsed and an expanded position in which the steps are spaced apart, the step assembly being configured such that the step assembly can be selectively positioned in the collapsed position or the expanded position when the platform is in the deployed position.

4. The platform assembly as claimed in claim 3, wherein the step assembly is configured to travel automatically between the collapsed position and the expanded position as the platform travels between the stowed position and the deployed position.

5. The platform assembly as claimed in claim 1, wherein the box assembly is sealed to prevent water entering the box assembly through the opening from leaving the box assembly except through the opening.

6. The platform assembly as claimed in claim 1, wherein the platform is configured to travel linearly with respect to the box assembly.

7. The platform assembly as claimed in claim 1 in combination with a fold down railing, the fold down railing comprising a handle that can be placed in a stowed position and a deployed position in which the handle may be grasped by a person on the boat or boarding the boat from an outboard location.

8. The platform assembly as claimed in claim 7, wherein the platform and the handle can be used simultaneously by the person on the boat or boarding the boat from the overboard location when the platform is in its respective deployed position and the railing is in its respective deployed position.

9. The platform assembly as claimed in claim 1, further comprising an actuator arranged to move the platform relative to the box assembly between the stowed position and the deployed position.

10. The platform assembly as claim in claim 9, further comprising a quick release connector operatively connecting the actuator to the platform, the quick release connector being configured to release connector of the actuator to the platform to allow the platform to be manually moved with respect to the box assembly.

11. The platform assembly as claimed in claim 1, in combination with the boat.

12. A platform assembly for a boat comprising:

a box assembly adapted for mounting generally within the boat, the box assembly having a distal opening, a platform configured to travel between a stowed position and a deployed position, the stowed position being substantially inside the box assembly and the deployed position protruding outward from the box assembly through the distal opening, an actuator arranged to move the platform relative to the box assembly between the stowed position and the deployed position, and a quick release connector operatively connecting the actuator to the platform to allow the platform to be manually moved with respect to the box assembly, the quick release connector including an actuator located outside of the box assembly in the stowed position of the platform.

13. The platform assembly as claimed in claim 12, further comprising one or more switches configured to automatically control the travel of the platform.

14. The platform assembly as claimed in claim 12, further comprising a fold down railing, the fold down railing comprising a handle that can be placed in a stowed position and a deployed position in which the handle may be grasped by a person on the boat or boarding the boat from an overboard location.

15. The platform assembly as claimed in claim 14, wherein the platform and the handle can be used simultaneously by the person on the boat or boarding the boat from the overboard location when the platform is in its respective deployed position and the railing is in its respective deployed position.

16. The platform assembly as claimed in claim 13, wherein the actuator is operatively connected to said one or more switches so that said one or more switches control operation of the actuator to move the platform between the stowed and deployed positions.

17. The platform assembly as claimed in claim 12 in combination with the boat.

* * * * *